US007460114B2

(12) United States Patent
Mizumaki

(10) Patent No.: US 7,460,114 B2
(45) Date of Patent: Dec. 2, 2008

(54) DISPLAY DEVICE AND DRIVING CIRCUIT FOR THE SAME DISPLAY METHOD

(75) Inventor: Hidetaka Mizumaki, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 718 days.

(21) Appl. No.: 10/937,416

(22) Filed: Sep. 10, 2004

(65) Prior Publication Data

US 2005/0062706 A1 Mar. 24, 2005

(30) Foreign Application Priority Data

Sep. 18, 2003 (JP) ..... 2003-325879

(51) Int. Cl.
*G09G 5/00* (2006.01)

(52) U.S. Cl. ..... 345/204; 345/92; 345/94; 345/95; 345/98; 345/100

(58) Field of Classification Search ..... 345/204, 345/92, 94–95, 98, 100
See application file for complete search history.

(56) References Cited

U.S. PATENT DOCUMENTS 5,587,722 A 12/1996 Suzuki et al.
6,229,531 B1 * 5/2001 Nakajima et al. ..... 345/205
6,359,607 B1 3/2002 Yanagi et al.
7,002,542 B2 * 2/2006 Lee ..... 345/94

FOREIGN PATENT DOCUMENTS

JP 6-110035 A 4/1994

* cited by examiner

*Primary Examiner*—Richard Hjerpe
*Assistant Examiner*—Leonid Shapiro
(74) *Attorney, Agent, or Firm*—Harness, Dickey & Pierce, P.L.C.

(57) ABSTRACT

A display device is for carrying out display by supplying a data signal, that is supplied from a video signal line, to one of a plurality of pixel electrodes via a switching element, and by supplying a scanning signal for controlling ON/OFF state of the switching element to the switching element via a scanning signal line that is orthogonal to the video signal line and is connected to the switching element. When the scanning signal is outputted to the scanning signal line, the scanning signal has a falling waveform that first falls substantially vertically from an ON-level of the switching element in a direction of an OFF-level of the switching element, and then starts falling with a slope, and again falls substantially vertically before reaching the OFF-level of the switching element. As such, the writing of the data signal to the pixel electrode may be securely carried out even when the writing period for each scanning signal is reduced, thereby displaying a high-quality image.

19 Claims, 9 Drawing Sheets

DISPLAY DEVICE AND DRIVING CIRCUIT FOR THE SAME DISPLAY METHOD

This Nonprovisional application claims priority under 35 U.S.C. § 119(a) on Patent Application No. 2003/325879 filed in Japan on Sep. 18, 2003, the entire contents of which are hereby incorporated by reference.

FIELD OF THE INVENTION

The present invention generally relates to a matrix display device and method. Particularly, the present invention relates to a display device having a switching element such as a thin film transistor for each of the display pixels, and also to the driving circuit and the display method thereof.

BACKGROUND OF THE INVENTION

A liquid crystal display device is widely used as a display device of a TV, a monitor of a personal computer etc. Particularly, a liquid crystal display device having a switching element such as a thin film transistor (hereinafter also referred to as a TFT) offers superior image display even with a larger number of display pixels, without causing crosstalk between adjacent display pixels.

FIG. 5 shows this type of liquid crystal display device. The major part of the device includes a liquid crystal display panel 1 and a driving circuit section. The liquid crystal display panel 1 is made up of a pair of electrode substrates and a liquid crystal composition held between the substrates. Each external surface of the electrode substrates is covered with a polarizing plate.

One of the electrode substrates is a TFT array substrate on which a plurality of signal lines S(1), S(2), . . . S(i), . . . S(N), and a plurality of scanning signal lines G(1), G(2) . . . G (j), . . . G(M) are formed on a transparent insulation substrate 100 made of a glass or the like in a matrix manner. Further, a switching element 102 made of a TFT connected to a pixel electrode 103 is formed on each of the intersections of the signal lines and the scanning lines. The insulative substrate 100 provided with such elements are entirely covered by an alignment film to function as a TFT array substrate.

The other electrode substrate is a counter substrate. As with the TFT array substrate, the counter substrate includes a transparent insulation substrate made of a glass or the like, the entire surface of which is covered with a counter electrode 101 and an alignment film laminated on each other. Further, the scanning signal lines of the display panel are connected to a scanning signal line driving circuit 300, the signal lines are connected to a signal line driving circuit 200, and the counter electrode is connected to a counter electrode driving circuit COM. These sections form the driving circuit section.

FIG. 6 shows an example of the scanning signal line driving circuit (gate driver) 300. This example is made up of a shift register section 3*a* having M flip-flops connected in a cascade manner, and a selection switches 3*b* that are operated according to the output of each flip-flop.

One of the input terminals VD 1 of each selection switch 3*b* is supplied with a gate-ON-voltage to turn on a TFT 102 (see FIG. 5), while the other input terminal VD2 is supplied with a gate-OFF-voltage to turn off the TFT 102. Therefore, a data signal (GSP) is sequentially transferred to each flip-flop in response to a clock signal (SCK), and then sequentially outputted to each selection switch 3*b*. Accordingly, the selection switch 3*b* outputs a voltage Vgh to turn on the TFT for 1 scanning period (TH) to the corresponding scanning signal line 105, and after the scanning period, outputs a voltage Vgl to turn off the TFT to the same scanning signal line 105. With this operation, a video signal outputted to each signal line 104 (see FIG. 5) from the signal line driving circuit 200 is written to a corresponding pixel.

FIG. 7 is an equivalent circuit diagram of a display pixel P(i, j) of a structure in which a pixel capacitor Clc and an auxiliary capacitor Cs are connected in parallel to a counter potential VCOM of a counter electrode driving circuit COM. In the figure, Cgd expresses a parasitic capacitor between gate-drain of the TFT.

FIG. 8 is a driven waveform chart of a conventional liquid crystal display device. In the figure, Vg expresses a waveform of a scanning signal line, Vs expresses a waveform of 1 signal line, and Vd expresses a drain waveform.

Here, a conventional driving method is explained below with reference to FIGS. 5, 7 and 8. Note that, it is widely known that the liquid crystal needs to be driven by alternating driving to prevent burnt image-lag or degradation of display. Accordingly, the following conventional driving method is explained using a frame inversion driving, an exemplary one of the alternating driving methods.

As shown in FIG. 8, in the first field, the scanning voltage Vgh is supplied from the scanning signal line driving circuit 300 to the gate electrode g(i, j) (see FIG. 5) of the TFT of a display pixel P(i, j), and the TFT turns on. As a result, the video signal voltage Vsp from the signal line driving circuit 200 is written to a pixel electrode via the source electrode and the drain electrode of the TFT. The pixel electrode holds the pixel potential Vdp until the scanning voltage Vgh is supplied in the next field (TF2), as shown in FIG. 8. Since the counter electrode is kept at a predetermined pixel potential Vdp by the counter electrode driving circuit COM, the liquid crystal composition held by the pixel electrode and the counter electrode responds according to the potential difference between the pixel potential Vdp and the counter potential VCOM, thereby displaying an image.

Similarly, as shown in FIG. 8, when the scanning voltage Vgh is supplied from the scanning signal line driving circuit 300 to the gate electrode g(i, j) of the TFT of a display pixel P(i, j) in the second field (TF1), the TFT turns on, and the video signal voltage Vsn from the signal line driving circuit 200 is written to a pixel electrode. The pixel electrode holds the pixel potential Vdn, and the liquid crystal composition responds according to the potential difference between the pixel potential Vdn and the counter potential VCOM, thereby displaying an image, and realizing liquid crystal alternating driving.

Further, as shown in FIG. 7, each TFT has a structure indispensably including a parasitic capacitor Cgd between gate and drain. Therefore, as shown in FIG. 8, a level shift ΔVd is caused in the pixel potential Vd at a fall of the scanning voltage Vgh due to the parasitic capacitor Cgd. The level shift ΔVd caused in the pixel potential Vd at a fall of the scanning voltage Vgh due to the parasitic capacitor Cgd can be expressed as $\Delta Vd = Cgd \cdot (Vgh - Vgl)/(Clc + Cs + Cgd)$ where Vgl denotes a non-scanning voltage (OFF-voltage of the TFT) of the scanning signal. This level shift causes a problem of flicker or degradation of display of the displayed image, and therefore unwanted for a liquid crystal display device aimed at further improving definition and quality.

In view of this problem, there has been a conventional method of applying a bias voltage to the counter electrode potential VCOM of the counter electrode, in order to reduce the level shift ΔVd caused by the parasitic capacitor Cgd in advance.

However, in the foregoing conventional method, when forming the scanning signal lines G(1), G(2) . . . G(j), . . .

G(M) on a transparent insulation substrate 100 made of a glass or the like as in FIG. 5, there are some difficulties of forming those scanning lines with ideal wiring that is free from a signal propagation delay characteristic. Therefore, it is unavoidable the scanning signal lines become signal propagation delay paths that cause the signal propagation delay characteristic to some extent.

FIG. 10 is a propagation equivalent circuit diagram for showing a signal propagation delay characteristic in a single scanning signal line G(j). In FIG. 10, rg1, rg2, rg3, . . . rgN mainly express a resistance component of the wiring material forming the scanning signal line, and a resistance component due to the wiring width and the wiring length. Further, cg1, cg2, cg3, . . . cgN are various parasitic capacitors that are in capacitive coupling relation to the scanning signal line in this structure. Each of the parasitic capacitors are made of such as a cross capacitor that is generated by intersection with the signal line. As described, the scanning signal line is a distributed-constant type signal propagation delay path.

FIG. 11 is an explanatory view illustrating a state where a scanning signal VG(j) supplied from the scanning signal line driving circuit onto the scanning signal line is becoming blunt inside the panel, due to the signal propagation delay characteristic. In the figure, the waveform Vg(1, j) denotes a waveform in the vicinity of the gate g(1, j) immediately after the output from the scanning signal line driving circuit 300. Bluntness can be hardly seen in this waveform. In contrast, in the same figure, the waveform Vg(N, j) denotes a waveform in the vicinity of the gate g(N, j) at the terminating end of the scanning signal line. This waveform is blunt due to the signal propagation delay characteristic of the scanning signal line. This waveform bluntness causes a variation amount SvN per unit time.

Further, the TFT is not an absolute ON/OFF switch, as it has a V-I characteristic (gate voltage-drain current characteristic) shown in FIG. 9. In the figure, the horizontal axis denotes a voltage supplied to the gate of the TFT, while the vertical axis denotes a drain current. Generally, the scanning pulse has a voltage level Vgh that is sufficient to turn on the TFT, and a voltage level Vgl that is sufficient to turn off the TFT. However, the scanning pulse also has an intermediate ON area (linear area) between the threshold value VT of TFT and the Vgl level.

Therefore, as shown in FIG. 11, in the pixel at the gate g(1, j) immediately after the scanning signal line driving circuit 300, the waveform rapidly falls from the Vgh level to the Vgl level of the scanning signal. Therefore, there is no influence of the characteristic in the linear area of the TFT, and therefore, it is possible to approximate the level shift ΔVd(1) caused by the parasitic capacitor Cgd to $\Delta Vd(1)=Cgd\cdot(Vgh-Vgl)/(Clc+Cs+Cgd)$.

However, in the pixel in the vicinity of gate g(N, j) at the terminating end of the scanning signal line, there is bluntness of a falling waveform of the scanning signal. Thus, the linear area characteristic of the TFT, and the level shift is caused at the pixel potential Vd due to the parasitic capacitor Cgd not occurring during a time where the scanning signal falls from the Vgh level to around the threshold level VT in which the TFT is ON in the linear manner. However, the level shift ΔVd(N) is caused at the pixel potential Vd(N, j) due to the parasitic capacitor Cgd during a time where the scanning signal varies from the threshold potential Vd to the Vgl level. Accordingly, the level shift ΔVd(N) is expressed as $\Delta Vd(N)<Cgd\cdot(Vgh-Vgl)/(Clc+Cs+Cgd)$, thereby satisfying $\Delta Vd(1)>\Delta Vd(N)$.

As in the foregoing example, the level shift ΔVd that occurs in the pixel potential Vd due to the parasitic capacitor Cgd is not uniform in the display screen. Therefore, it becomes more significant in a larger screen or high-definition display.

Accordingly, the conventional method using a bias of the counter electrode cannot cancel the unevenness of the level shift in the display screen. Thus, the pixels cannot be driven by the optimum alternating driving, thereby inducing some defects, such as flicker, or burnt image-lag due to application of DC component.

Japanese Patent Publication No. 3406508 (published on Oct. 15, 1999) (U.S. Pat. No. 6,359,607B1) discloses an invention intended to solve such a conventional problem. This patent document discloses a display device and method in which the scanning signal has such a falling waveform, when outputted to the scanning signal line, that it falls with a slope from an ON-level of the switching element, and then falls substantially vertically before reaching the OFF-level of the switching element. With this arrangement, the invention of the patent document successfully reduce occurrence of flicker etc. caused by fluctuation of pixel potential due to the parasitic capacitor.

Further, even though the wiring formed on the transparent insulation substrate made of a glass or the like is not an ideal wiring path free from signal delay but a signal delay path causing some signal delay, the foregoing invention cancels display unevenness due to the signal delay. It further reduces and equalizes a level shift that occurs at a pixel potential due to the parasitic capacitor. As a result, the image display can be performed with higher definition and quality.

SUMMARY OF THE INVENTION

Recent liquid crystal display devices have a higher-resolution, thus requiring more scanning signal lines. Therefore, the writing period for each scanning signal (a period where a data signal inputted from a video signal line is supplied to a pixel electrode via a switching element such as a TFT) is reduced. Aside from this, upon input of the data signal, the switching element generates a greater driving power if the margin from the threshold level is larger. In view of this, when the data signal is supplied via the switching element, the scanning signal preferably has a potential sufficient to turn on the switching element.

In view of this, the scanning signal of the display device and display method of the foregoing patent document has a waveform that first falls with a gentle slope from the ON-level of the switching element, and varies until it reaches the OFF-level of the switching element. In this case, the ON-level of the switching element needs to be a high potential. Therefore the slope of the variation of the scanning signal from the ON-level to OFF-level of the switching element needs to continue for some time. Accordingly, if the writing period for each scanning signal is reduced in order to obtain a higher-resolution, a sufficient writing period may not be ensured.

An embodiment of the present invention is made in view of the foregoing conventional problem, and an object is to provide a display device capable of driving a switching element with a sufficient power, and securely carrying out writing of a data signal even with a less writing period for each scanning signal, thereby ensuring high-quality image display. An embodiment of the present invention further provides a driving circuit and a display method of the display device.

A display device of an embodiment of the present invention is a display device for carrying out display by supplying a data signal, that is supplied from a video signal line, to one of a plurality of pixel electrodes via a switching element, and supplying a scanning signal for controlling ON/OFF state of the switching element to the switching element via a scanning signal line that is orthogonal to the video signal line and is connected to the switching element. In such a device of an embodiment of the present invention, when the scanning signal is outputted to the scanning signal line, the scanning signal has a falling waveform that first falls substantially vertically from an ON-level of the switching element in a direction of an OFF-level of the switching element, and then starts falling with a slope, and again falls substantially vertically before reaching the OFF-level of the switching element.

A display method of an embodiment of the present invention is a display method for carrying out display by supplying a data signal, that is supplied from a video signal line, to one of a plurality of pixel electrodes via a switching element, and supplying a scanning signal for controlling ON/OFF state of the switching element to the switching element via a scanning signal line that is orthogonal to the video signal line and is connected to the switching element. In such a method, when outputted to the scanning signal line, the scanning signal has a falling waveform that first falls substantially vertically from an ON-level of the switching element in a direction of an OFF-level of the switching element, and then starts falling with a slope, and again falls substantially vertically before reaching the OFF-level of the switching element.

The display device of at least embodiment may be arranged so that: the ON-level of the switching element is a ON-voltage of the switching element, the direction of an OFF-level of the switching element is a direction of a OFF-voltage of the switching element, and the OFF-level of the switching element is a OFF-voltage of the switching element.

The display method of at least one embodiment may be arranged so that: the ON-level of the switching element is a ON-voltage of the switching element, the direction of an OFF-level of the switching element is a direction of a OFF-voltage of the switching element, and the OFF-level of the switching element is a OFF-voltage of the switching element.

The display device of at least one embodiment may be arranged so that: the scanning signal is supplied to a gate of the switching element, the ON-level of the switching element is a gate-ON-voltage of the switching element, the direction of an OFF-level of the switching element is a direction of a gate-OFF-voltage of the switching element, and the OFF-level of the switching element is a gate-OFF-voltage of the switching element.

The display method of at least one embodiment may be arranged so that: the scanning signal is supplied to a gate of the switching element, the ON-level of the switching element is a gate-ON-voltage of the switching element, the direction of an OFF-level of the switching element is a direction of a gate-OFF-voltage of the switching element, and the OFF-level of the switching element is a gate-OFF-voltage of the switching element.

The display device of at least one embodiment may be arranged so that: the switching element is a thin film transistor, the scanning signal is supplied to a gate of the thin film transistor, the ON-level of the switching element is a gate-ON-voltage of the thin film transistor, the direction of an OFF-level of the switching element is a direction of a gate-OFF-voltage of the thin film transistor, and the OFF-level of the switching element is a gate-OFF-voltage of the thin film transistor.

The display method of at least one embodiment may be arranged so that: the switching element is a thin film transistor, the scanning signal is supplied to a gate of the thin film transistor, the ON-level of the switching element is a gate-ON-voltage of the thin film transistor, the direction of an OFF-level of the switching element is a direction of a gate-OFF-voltage of the thin film transistor, and the OFF-level of the switching element is a gate-OFF-voltage of the thin film transistor.

The display device of at least one embodiment may be arranged so that: the scanning signal supplied to the switching element to control ON/OFF state of the switching element is a scanning signal having a high-level and a low-level and is supplied to a gate of the switching element, the ON-level of the switching element is the high-level, the direction of an OFF-level of the switching element is a direction of the low-level, and the OFF-level of the switching element is the low-level.

The display method of at least one embodiment may be arranged so that: the scanning signal supplied to the switching element to control ON/OFF state of the switching element is a scanning signal having a high-level and a low-level and is supplied to a gate of the switching element, the ON-level of the switching element is the high-level, the direction of an OFF-level of the switching element is a direction of the low-level, and the OFF-level of the switching element is the low-level.

The display device of at least one embodiment may be arranged so that: the switching element is a thin film transistor, the scanning signal supplied to the switching element to control ON/OFF state of the switching element is a scanning signal having a high-level and a low-level and is supplied to a gate of the thin film transistor, the ON-level of the switching element is the high-level, the direction of an OFF-level of the switching element is a direction of the low-level, and the OFF-level of the switching element is the low-level.

The display method of at least one embodiment may be arranged so that: the switching element is a thin film transistor, the scanning signal supplied to the switching element to control ON/OFF state of the switching element is a scanning signal having a high-level and a low-level and is supplied to a gate of the thin film transistor, the ON-level of the switching element is the high-level, the direction of an OFF-level of the switching element is a direction of the low-level, and the OFF-level of the switching element is the low-level.

As described, in the display device and the display method of at least one embodiment the present invention, when outputted to the scanning signal line, the scanning signal has a falling waveform that (1) first falls substantially vertically from an ON-level of the switching element in a direction of an OFF-level of the switching element, and then starts falling with a slope, and again falls substantially vertically before reaching the OFF-level of the switching element, (2) a falling waveform that first falls substantially vertically from a ON-voltage of the switching element in a direction of a OFF-voltage of the switching element, and then starts falling with a slope, and again falls substantially vertically before reaching the OFF-voltage of the switching element, (3) a falling waveform that first falls substantially vertically from a gate-ON-voltage of the switching element in a direction of a gate-OFF-voltage of the switching element, and then starts falling with a slope, and again falls substantially vertically before reaching the gate-OFF-voltage of the switching element, (4) a falling waveform that first falls substantially vertically from a gate-ON-voltage of the thin film transistor in a direction of a gate-OFF-voltage of the thin film transistor, and then starts falling with a slope, and again falls substantially vertically before reaching the gate-OFF-voltage of the thin film transistor, (5) a falling waveform that first falls substantially vertically from a high-level in a direction of a low-level, and then starts falling with a slope, and again falls substantially vertically before reaching the low-level, or (6) a falling waveform that first falls substantially vertically from a high-level in a direction of a low-level, and then starts falling with a slope, and again falls substantially vertically before reaching the low-level.

Accordingly, as with the foregoing display device and display method of at least one embodiment, the scanning signal has a falling waveform partly varying with a slope, thereby avoiding a rapid fall of the scanning signal. On this account, the level shift of the pixel electrode caused by the parasitic capacitor is reduced, thereby achieving high-definition and high-quality display.

Further, since the falling waveform of the scanning signal first falls substantially vertically before falling with a slope, it is possible to ensure sufficient voltage (level) for allowing the scanning signal to supply the data signal to a pixel via the switching element such as a thin film transistor. On this account, the writing of the data signal to the pixel electrode may be securely carried out even when the writing period for each scanning signal is reduced. Therefore, this structure is immune to defect due to reduction of writing period in a display device of higher resolution.

In at least one other embodiment, in another simple form, the method for driving a display device may include storing a display signal with a falling waveform which changes slope a plurality of times and driving the display device using the stored display signal. The display device may be a matrix display device and the display signal may be a voltage signal; or more specifically the display device the display signal may be a data signal that is supplied to one of a plurality of pixel electrodes of the matrix display device via a switching element.

The display device of at least one embodiment may be arranged so that: the scanning signal is produced based on a scanning signal production signal that has a high-level section, a rising section rising up to a beginning of the high-level section, a first falling section falling substantially vertically from a terminating end of the high-level section, and a second falling section falling and varying with a slope from a terminating end of the first falling section.

The display method of at least one embodiment may be arranged so that: the scanning signal is produced based on a scanning signal production signal that has a high-level section, a rising section rising up to a beginning of the high-level section, a first falling section falling substantially vertically from a terminating end of the high-level section, and a second falling section falling and varying with a slope from a terminating end of the first falling section.

The foregoing structure in which the scanning signal is produced based on the scanning signal production signal that has a high-level section, a rising section, a first falling section and a second falling section enables appropriate production of the scanning signal.

The display device of at least one embodiment may be arranged so that the display device further includes: a signal production circuit for producing the scanning signal production signal, the signal production circuit including: a first input section for inputting a first voltage corresponding to the high-level section; a second input section for inputting a second voltage corresponding to a potential difference between the first voltage and a voltage at a beginning end of the second falling section; a charging section of the first voltage; a discharging section for carrying out discharging of the charging section with a predetermined time constant; a voltage subtracting section for subtracting the second voltage from an output voltage of the charging section; and a switching section for carrying out switching between (i) charging operation of the charging section with respect to the first voltage, and (ii) operation of the subtracting section and the discharging section.

The display method of at least one embodiment may be arranged so that: the scanning signal production signal is produced by keeping and charging for a predetermined period a first voltage corresponding to the high-level section, discharging the first voltage by a predetermined constant, and subtracting a second voltage, that corresponds to a potential difference between the first voltage and a voltage at a beginning end of the second falling section, from a discharge voltage.

The foregoing structure enables appropriate production of the scanning signal production signal.

A driving circuit of a display device of at least one embodiment of the present invention is a driving circuit of a display device for carrying out display by supplying a data signal, that is supplied from a video signal line, to one of a plurality of pixel electrodes via a switching element, and supplying a scanning signal for controlling ON/OFF state of the switching element to the switching element via a scanning signal line that is orthogonal to the video signal line and is connected to the switching element, wherein: the scanning signal has a falling waveform that first falls substantially vertically from an ON-level of the switching element in a direction of an OFF-level of the switching element, and then starts falling with a slope, and again falls substantially vertically before reaching the OFF-level of the switching element.

Accordingly, as with the foregoing display device and/or display method of at least one embodiment, the scanning signal has a falling waveform partly varying with a slope, thereby avoiding a rapid fall of the scanning signal. On this account, the level shift of the pixel electrode caused by the parasitic capacitor is reduced, thereby achieving high-definition and high-quality display.

Further, since the falling waveform of the scanning signal first falls substantially vertically before falling with a slope, it is possible to ensure sufficient voltage (level) for allowing the scanning signal to supply the data signal to a pixel via the switching element such as a thin film transistor. On this account, the writing of the data signal to the pixel electrode may be securely carried out even when the writing period for each scanning signal is reduced. Therefore, this structure may be immune to defect due to reduction of writing period in a display device of higher resolution.

The foregoing driving circuit of at least one embodiment of a display device may be arranged so that: the scanning signal is produced based on a scanning signal production signal that has a high-level section for forming the ON-level of the switching element, a rising section rising up to a beginning end of the high-level section, a falling section falling substantially vertically from a terminating end of the high-level section in the direction of an OFF-level of the switching element, and a slope falling section falling and varying with a slope from a terminating end of the falling section.

The foregoing driving circuit of a display device of at least one embodiment has an arrangement in which the scanning signal is produced based on a scanning signal production signal that has a high-level section, a rising section, a falling section, and a slope falling section, thereby appropriately producing the scanning signal.

BRIEF DESCRIPTION OF THE DRAWINGS

Additional objects, features, and strengths of the present invention will be made clear by the description of exemplary embodiments below. Further, the advantages of the present invention will be evident from the following explanation in reference to the drawings.

DETAILED DESCRIPTION OF THE EMBODIMENTS

Figure 1:
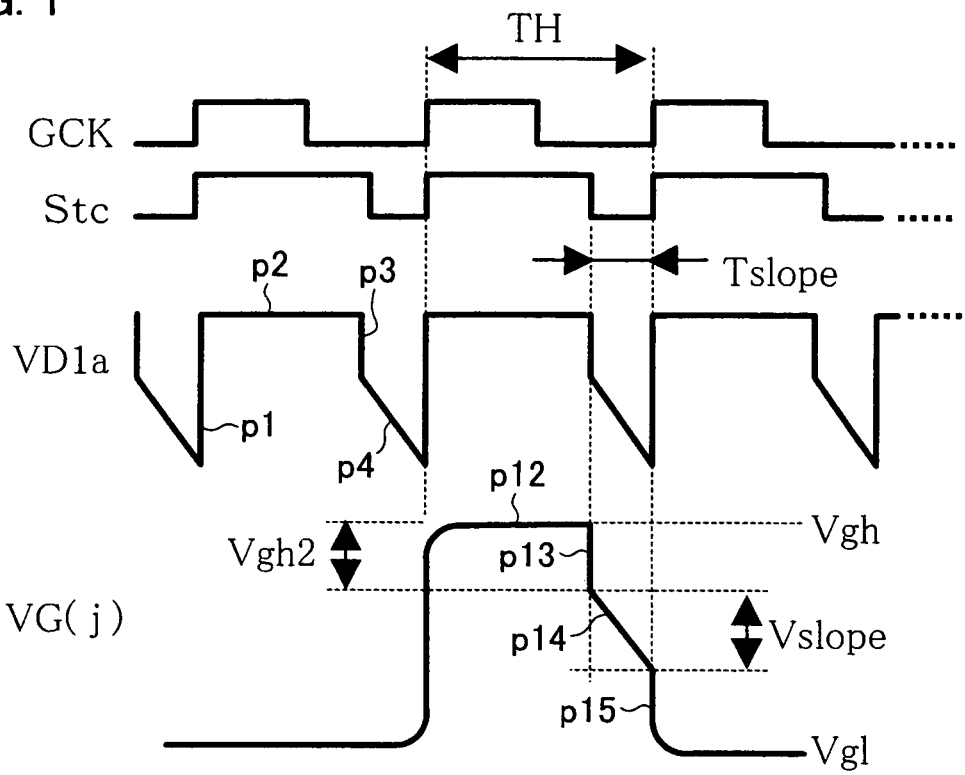
FIG. 1 is a waveform chart of the major part of a scanning signal line driving circuit according to an embodiment of the present invention.

The following will explain one embodiment of the present invention with reference to FIG. 1.

Figure 2:
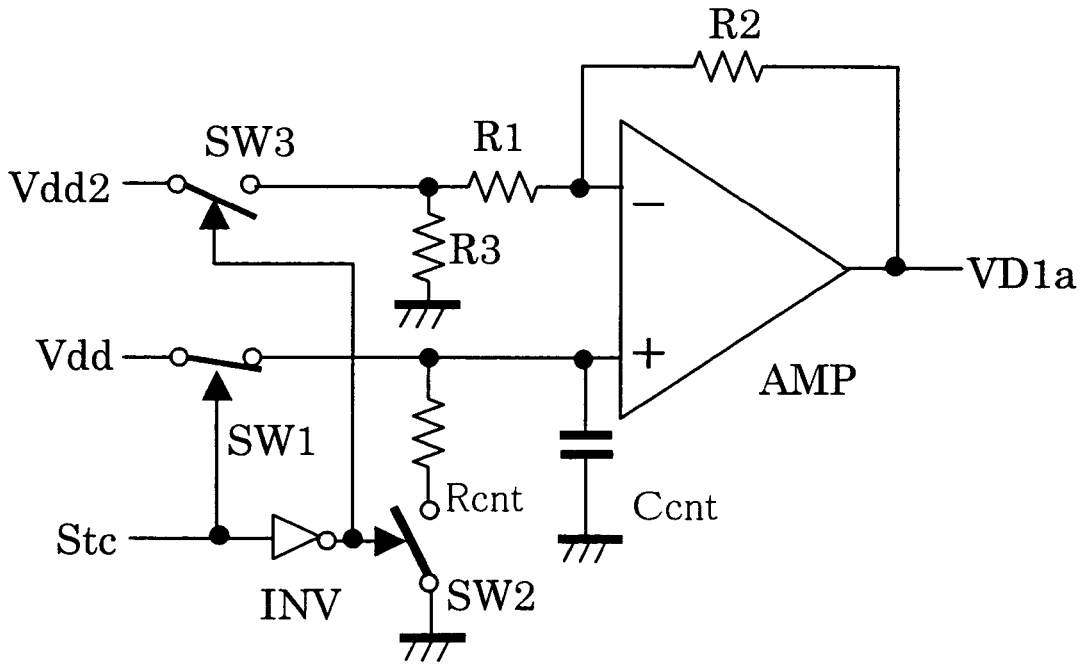
FIG. 2 is a circuit diagram illustrating the major part a scanning signal line driving circuit according to an embodiment of the present invention.

The following will explain another embodiment of the present invention with reference to FIG. 2. For ease of explanation, materials having the equivalent functions as those shown in the drawings pertaining to Embodiment 1 above will be given the same reference symbols, and explanation thereof will be omitted here.

REFERENCE EXAMPLE

Figure 3:
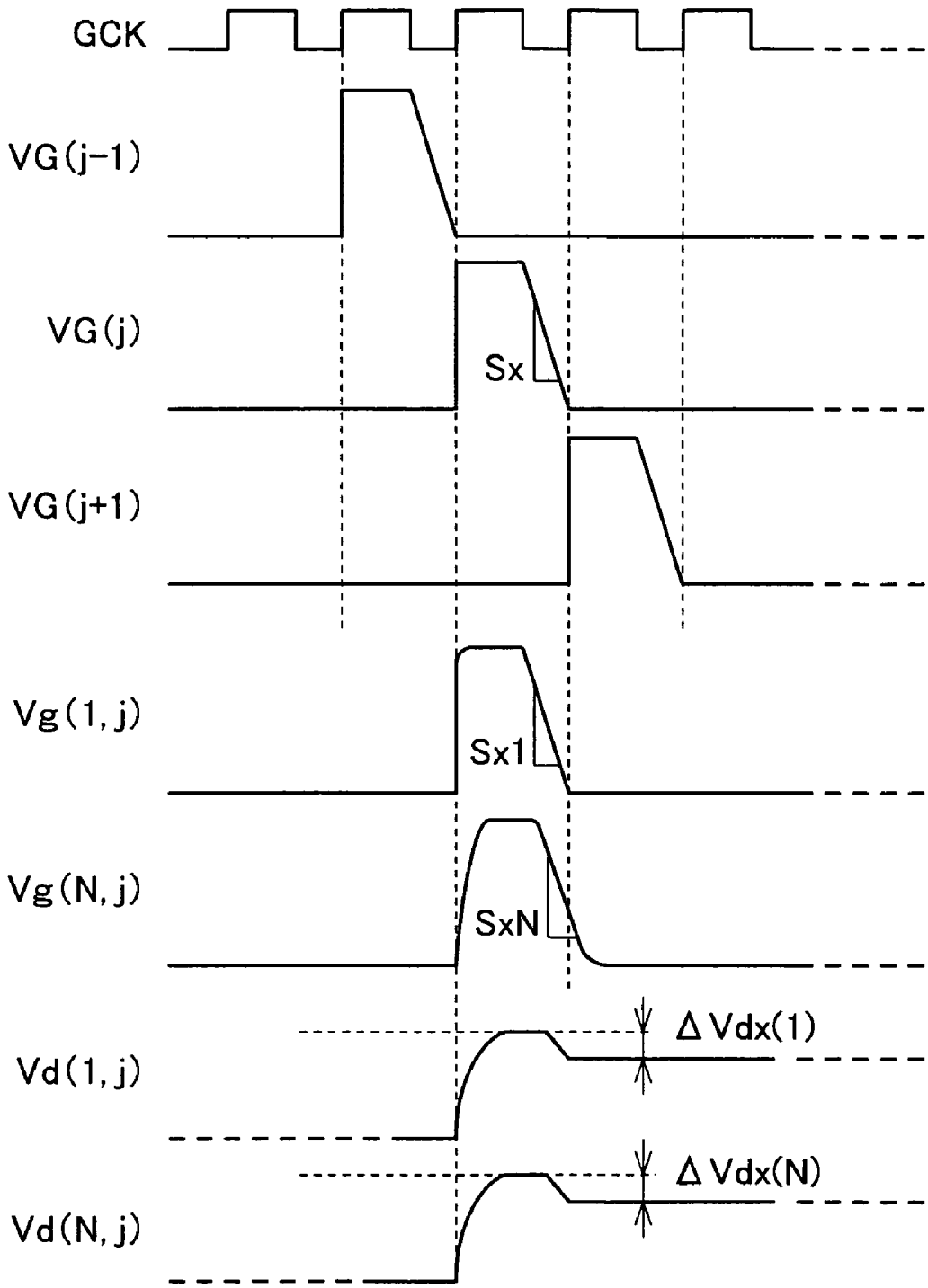
FIG. 3 is a waveform chart showing output waveforms of the respective sections of a scanning signal line driving circuit according to a reference example of an embodiment of the present invention.
Figure 4:
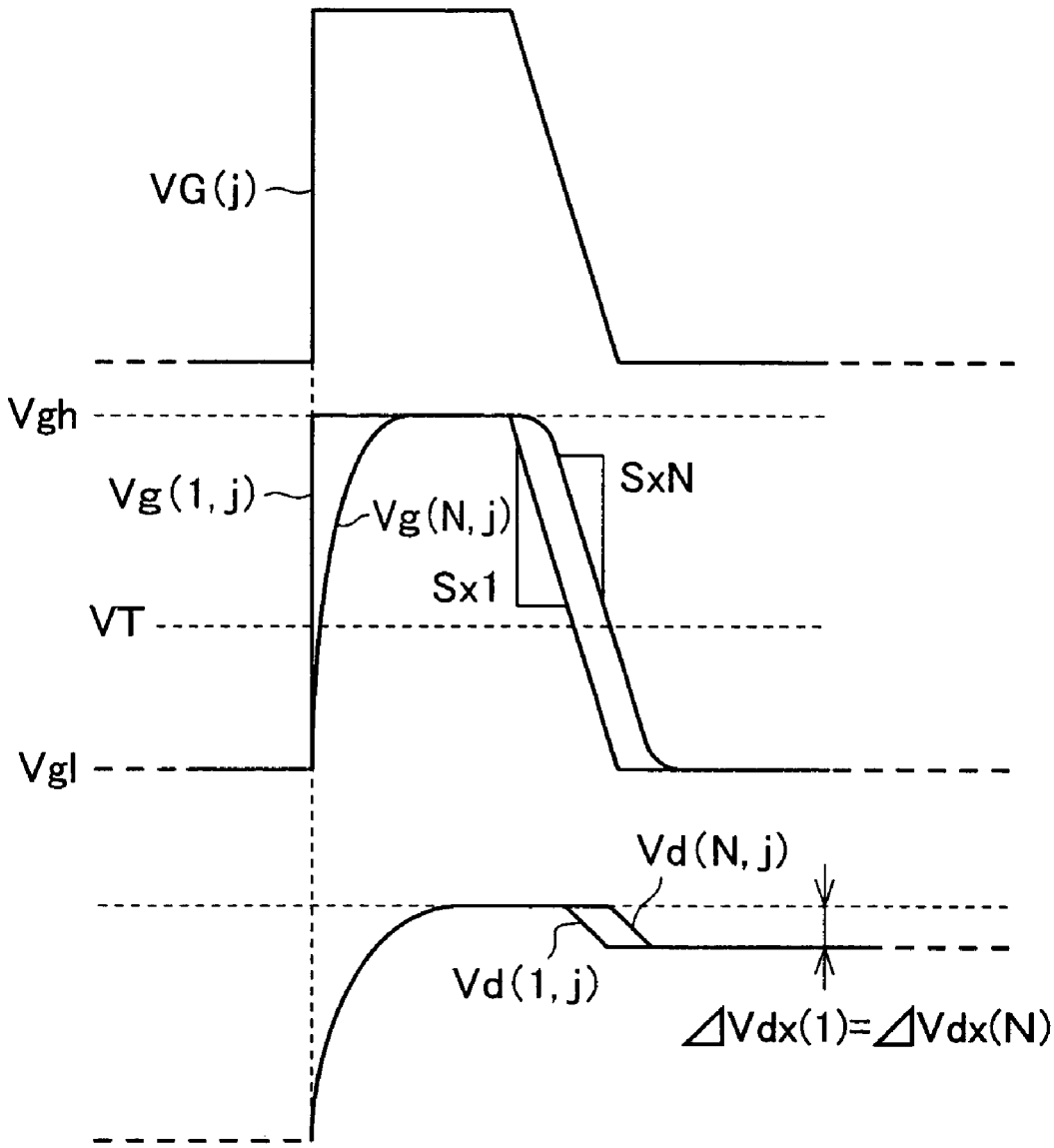
FIG. 4 is a waveform chart showing a scanning waveform in the vicinity of the input section of the scanning signal line of FIG. 3, the waveform of the scanning signal line in the vicinity of the terminating end of the scanning signal line, and the respective pixel potentials.
Figure 5:
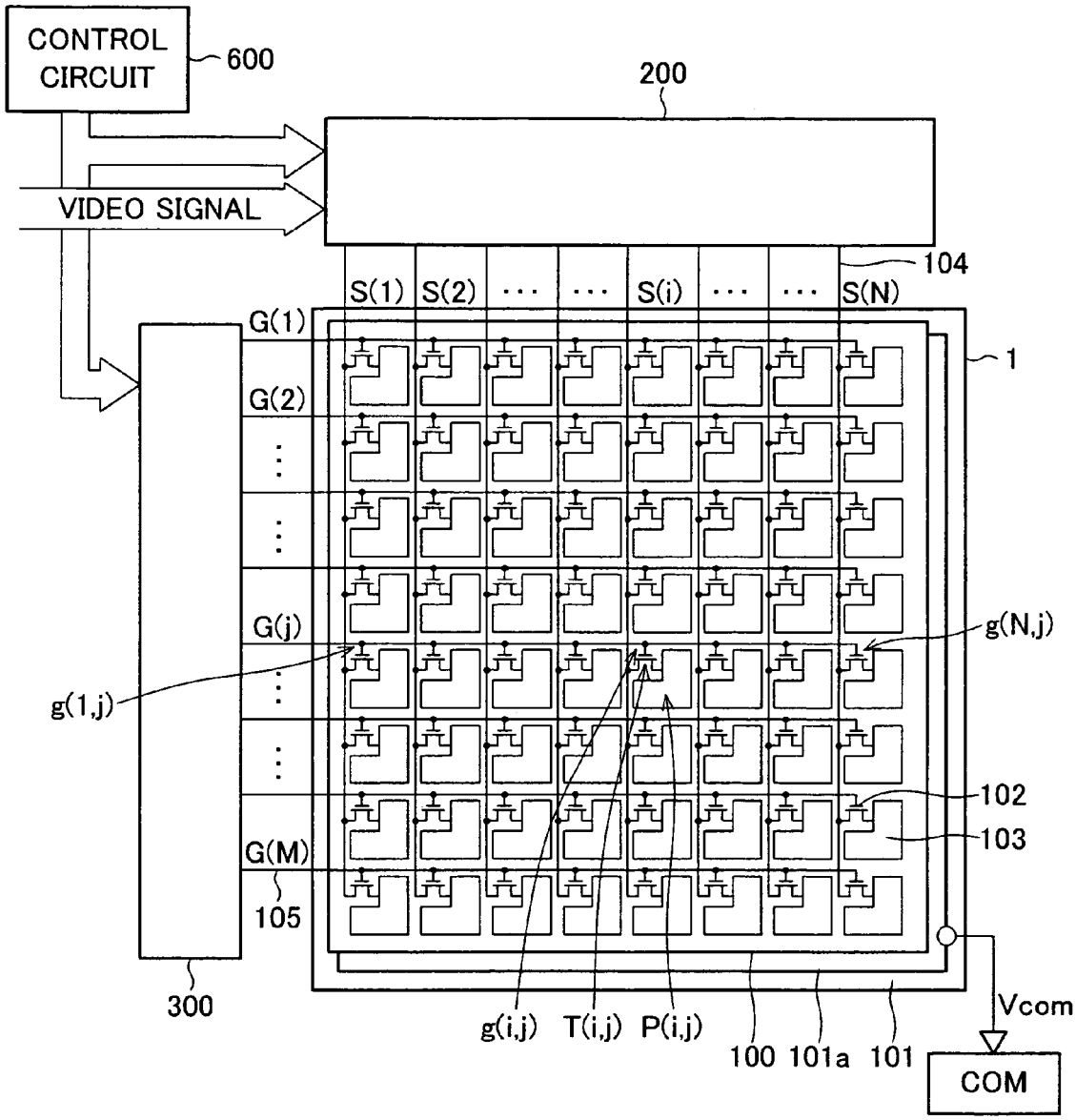
FIG. 5 is an explanatory view illustrating a structure of a conventional liquid crystal display device.

With reference to FIGS. 3 and 4, the following describes a reference example for the embodiment according to the present invention. In FIG. 3, GCK expresses a clock signal.

FIGS. 3 and 4 show various waveforms of a scanning signal line driving circuit according to the present reference example. The waveforms include output waveforms VG(j−1), VG(j) and VG(j+1); a scanning waveform Vg(1, j) in the vicinity of the input of the scanning signal line; a scanning signal line waveform Vg(N, j) in the vicinity of the terminating end of the scanning signal line; and the respective pixel potentials Vd(1, j) and Vd(N, j). As shown in FIG. 3, the output waveform VG(j) of the scanning signal line driving circuit varies with a sloped by a variation amount Sx per unit time when falling from the scanning voltage Vgh to the non-scanning voltage Vgl.

The structure of this reference example, which uses a display method in which a data signal is supplied to one of a plurality of pixel electrodes via a video signal line, and a scanning signal is supplied through a scanning signal line orthogonal to the video signal line to drive the pixel, also controls the falling waveform of the scanning signal upon driving of the pixel. The control is performed by setting the variation amount Sx to an arbitrary value.

As a result of the appropriate setting of the variation amount Sx, the respective variation amounts Sxl and SxN in the vicinity of the input of the scanning signal line and in the vicinity of the terminating end of the scanning signal line become substantially equal to each other as being free from the influence of a signal propagation delay characteristic, that parasitically exists in the scanning signal line, as can be seen in the scanning signal line waveforms Vg(1, j) and Vg(N, j) (see FIGS. 3 and 4). Consequently, the level shift generated in the pixel potential Vd due to the parasitic capacitance Cgd that parasitically exists in the scanning signal line becomes even in the display surface.

In this way, flicker was reduced by a conventional method of, for example, applying a counter potential VCOM to the counter electrode as a bias so as to previously reducing the level shift ΔVd due to such as the parasitic capacitance Cgd. Therefore, a resulting display device was immune to display defect such as sticking of a burnt image.

To realize the foregoing structure in which the variation amounts Sxl and SxN are substantially equal regardless their positions on the scanning line, the control of falling waveform should be performed in consideration of the signal propagation delay characteristic of the scanning signal line. In this way, it is possible to make substantially identical variation slope of the falling waveform at any portion of the scanning signal line, thereby substantially unifying the level shift in pixel potential.

The control of the falling waveform of the scanning signal based on the signal propagation delay characteristic may instead be control based on a gate voltage-drain current characteristic of the thin film transistor. In the thin film transistor, the drain current (ON-resistance) becomes dependent on the gate voltage in response to voltage application to the gate with a voltage in a range from the threshold voltage to the ON-voltage, thereby varying in a linear manner. More specifically, the thin film transistor is brought into not a binary ON state but an intermediate ON state (the drain current changes by the gate voltage in an analog manner).

In this case, if the falling waveform of the scanning signal is as sharp as that of conventional example, it causes the level shift in pixel potential due to the parasitic capacitance as in the case above, regardless of the gate voltage-drain current characteristic of the thin film transistor. However, this reference example allows control of the slope of the falling waveform of the scanning signal so that the scanning signal is under the influence of the linear variation area of the thin film transistor. This control makes the falling wavelength of the scanning signal to fall with a slope, and causes a linear change of the thin film transistor from ON state to OFF state according to the gate voltage-drain current characteristic, thereby securely reducing the level shift in pixel potential due to the parasitic capacitance.

More preferably, the slope of the falling waveform of the scanning signal is controlled in consideration of both the signal propagation delay characteristic and the gate voltage-drain current characteristic. In this way, it is possible to make substantially identical variation slope of the falling waveform at any portion of the scanning signal line, thereby substantially unifying the level shift in pixel potential while reducing the level shift itself.

Figure 9:
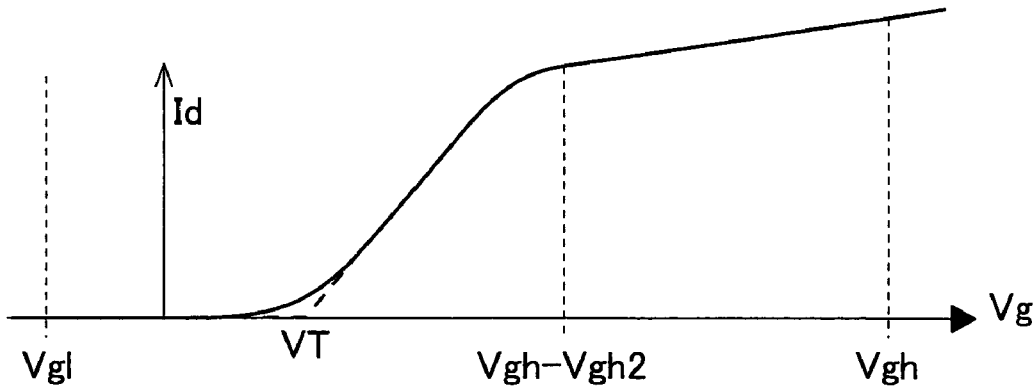
FIG. 9 is an explanatory view for both the present invention and prior art, showing that a thin film transistor has a linear gate voltage-drain current characteristic, and therefore does not function as an absolute ON/OFF switch.
Figure 10:
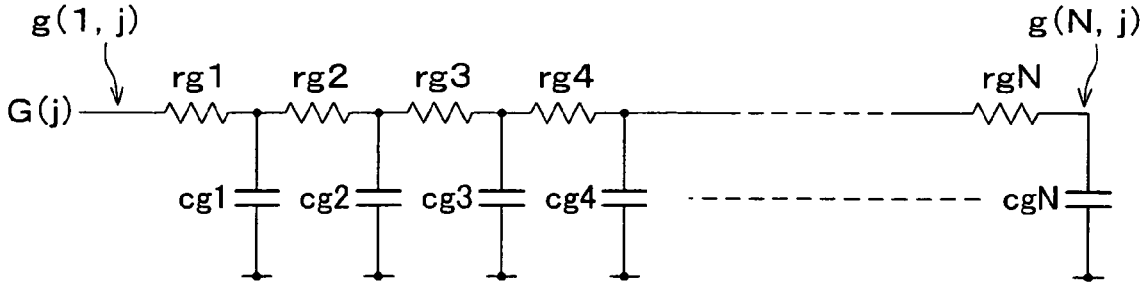
FIG. 10 is a propagation equivalent circuit showing a signal propagation delay characteristic in a scanning signal line.
Figure 11:
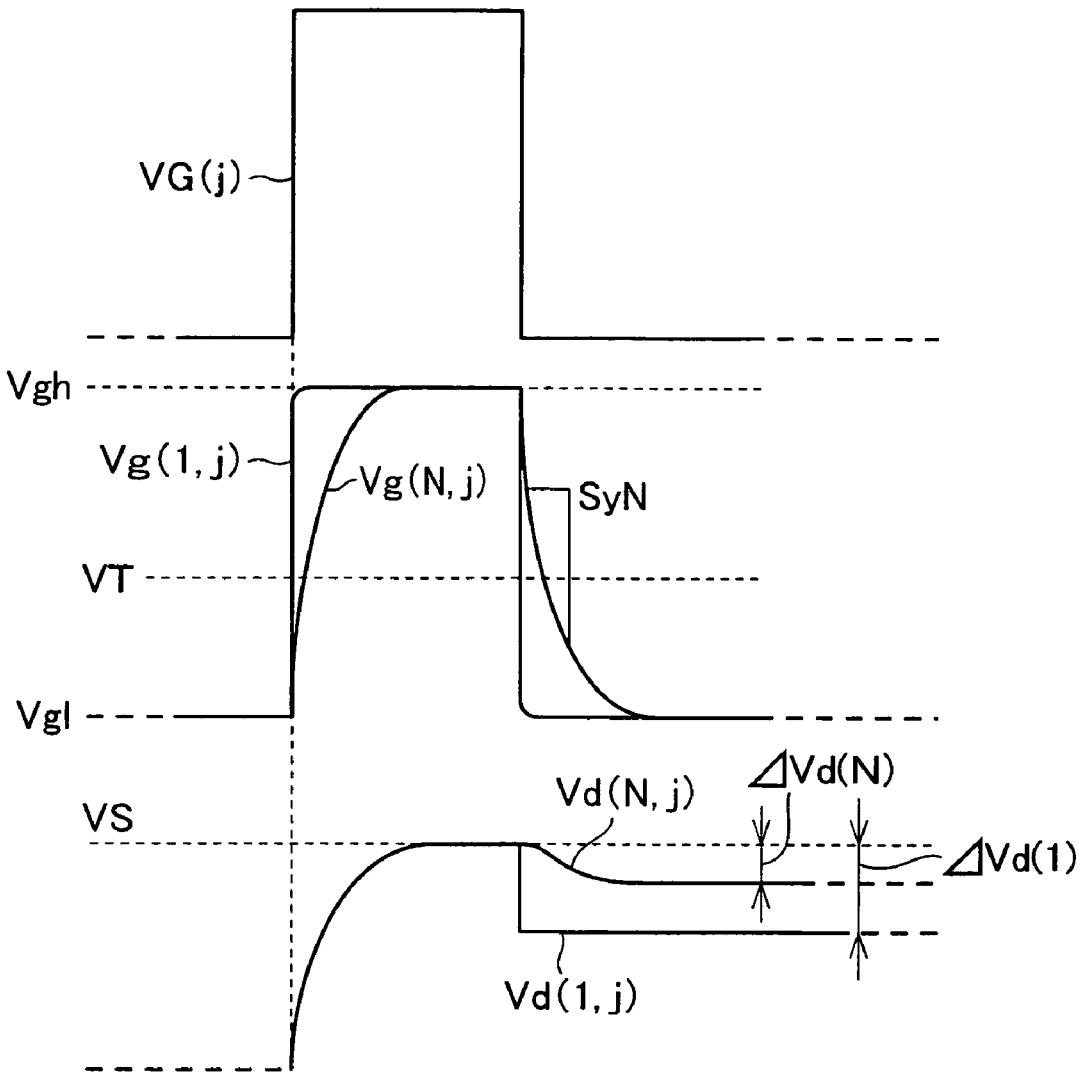
FIG. 11 is an explanatory view illustrating a state where a scanning signal supplied from the scanning signal line driving circuit onto the scanning signal line is becoming blunt inside the panel, due to the signal propagation delay characteristic.

Further, the voltage level VT of FIG. 4 is the threshold voltage of the TFT that is shown in FIG. 9. The TFT turns on during a period where the scanning signal falls from the scanning voltage Vgh to the threshold voltage VT, and therefore the level shift due to the parasitic capacitance Cgd seldom occur. On the other hand, the level shift due to the parasitic capacitance Cgd occurs because of the variation value (VT−Vgl) of the scanning signal line that turns off the TFT.

According to the present reference example in which VT−Vgl<Vgh−Vgl, unevenness of the level shift in the display surface, that is caused by the parasitic capacitance Cgd, was cancelled, while also reducing the amount of the level shift itself due to the parasitic capacitance Cgd.

Here, it is assumed that the level shift generated in the pixel potential Vd due to the parasitic capacitance Cgd of a pixel in the vicinity of a conventional scanning signal line driving circuit is ΔVd(1), the level shift amount of a pixel in the vicinity of the terminating end is ΔVd(N). Further, the level shift generated in the pixel potential Vd due to the parasitic capacitance Cgd of a pixel in the vicinity of a scanning signal line driving circuit according to the present reference is ΔVdx (1), the level shift amount of a pixel in the vicinity of the terminating end is ΔVdx(N).

In this case, the variation amounts of Sxl and SxN of the falling waveform are substantially the same as being free from the influence of the signal propagation delay characteristic that parasitically exists in the scanning signal line. Accordingly, the level shift generated in the pixel potential Vd due to the parasitic capacitance Cgd becomes substantially even in the display surface, thereby satisfying ΔVdx(1)=ΔVdx(N)<ΔVd(N)<ΔVd(1).

Therefore, the conventional method of, for example, applying a counter potential VCOM to the counter electrode as a bias so as to previously reducing the level shift due to the parasitic capacitance Cgd can be performed with a smaller bias level. In this manner, flicker can be reduced, thus obtaining a display device that consumes less power and is immune to display defect such as a burnt image lag.

[Embodiment]

One embodiment of the present invention is described below mainly with reference to FIGS. 1 and 2, as an example using a conventional general-purpose low-cost scanning signal line driving circuit (gate driver). FIG. 2 is a circuit diagram illustrating a structure of a major part of the scanning signal line driving circuit of the present embodiment, in other words, a signal production circuit included in the scanning signal line driving circuit. FIG. 1 is a waveform diagram of the major part of the scanning signal line driving circuit of the embodiment of the present invention shown in FIG. 2. Note that, according to the circumstances, the explanation below also uses the drawings referred in the explanation of the prior art.

As explained above with reference to FIG. 6, a conventional scanning signal line driving circuit (gate driver) is arranged such that the gate-ON-voltage Vgh and the gate-OFF-voltage Vgl are supplied to the input terminals VD1 and VD2, respectively, and the scanning-on voltage Vgh is outputted one by one to each scanning signal line 105 for 1 scanning period (TH) in response to the clock signal GCK, and then, at the end of the scanning period, the Vgl voltage is outputted to the scanning signal line 105 to turn off the TFT (switching element) 102. In contrast, the present Embodiment 1 uses a signal production circuit shown in FIG. 2, whose output is used as the Vgh voltage of the scanning signal line driving circuit.

As shown in FIG. 2, the signal production circuit mainly includes a resistor Rcnt and a capacitor Ccnt for charging/discharging; an inverter INV for controlling the charging/discharging; switches SW1 and SW2 for switching between the charging and discharging; a switch SW3 for switching voltage application between the gate-ON-voltage and a voltage for producing a decrease voltage Vgh2, that is a voltage corresponding to a decrease amount from the gate-ON-voltage Vgh to a voltage for starting the charging/discharging; and an amplifier AMP, such as an OP amplifier including resistors R1, R2 and R3 for changing the amplification level.

A signal voltage Vdd is applied to one of the terminals of the switch SW1. The signal voltage Vdd is a direct current having a level Vgh that is sufficient to turn on the TFT 102. The other terminal of the switch SW1 is connected to one of the terminal of the resistor Rcnt, also to one of the terminals of the capacitor Ccnt, and further to a noninverting terminal of the amplifier AMP. The other terminal of the resistor Rcnt is connected to ground via the switch SW2.

Open/close control of the switch SW2 is performed according to a Stc signal (see FIG. 1) supplied through the inverter INV. The Stc signal is synchronized with 1 scanning period, and is also used for open/close control of the switch SW1. As shown in FIG. 1, the Stc signal is created to be synchronized with the clock signal (GCK), and can be generated from a mono-multi vibrator (not shown) or the like.

A signal voltage Vdd2 is applied to one of the terminals of the switch SW3. The signal voltage Vdd2 is a direct current and a base of the decrease voltage Vgh2. The other terminal of the switch SW3 is connected to an inverting terminal of the amplifier AMP. The inverting terminal is connected to the output terminal thereof via the resistor R2. In this structure, if the values of the resistor 1 and the resistor 2 are equal, an output signal (output voltage) VD1 from the amplifier AMP has a value that can be found by subtracting the decrease voltage Vgh2 from the gate-ON-voltage Vgh.

In the present embodiment, the resistors R1 and R2 have the same value. The resistor 3 is used for input impedance matching, and functions particularly to prevent unstable voltage input to the inverting terminal of the amplifier AMP when the switch SW3 is ON. The switch SW1 turns off when the Stc signal is at a high level. Here, the switches 2 and 3 turn on as they are supplied with a low-level signal via the inverter INV.

On the other hand, the switch SW1 turns on when the Stc signal is at a low level (discharge control signal). Here, the switches 2 and 3 turn off as they are supplied with a high-level signal via the inverter INV. Accordingly, in the structure of FIG. 2, the switches SW1, SW2 and SW3 are high-active elements. Open/close control of the switches SW1, SW2 and SW3 will be more specifically described later.

Figure 6:
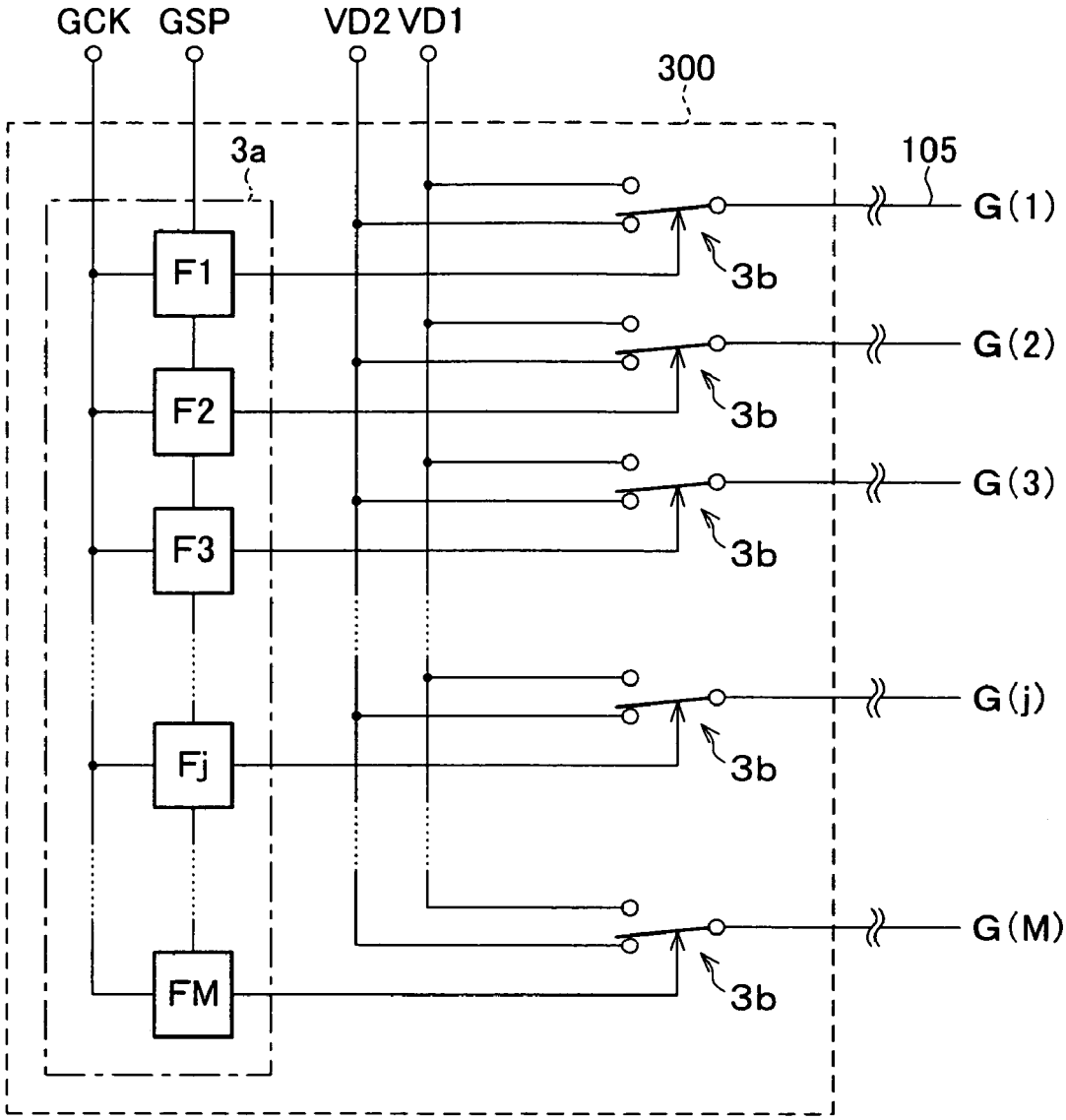
FIG. 6 is an explanatory view illustrating a structure example of a conventional scanning signal line driving circuit.
Figure 7:
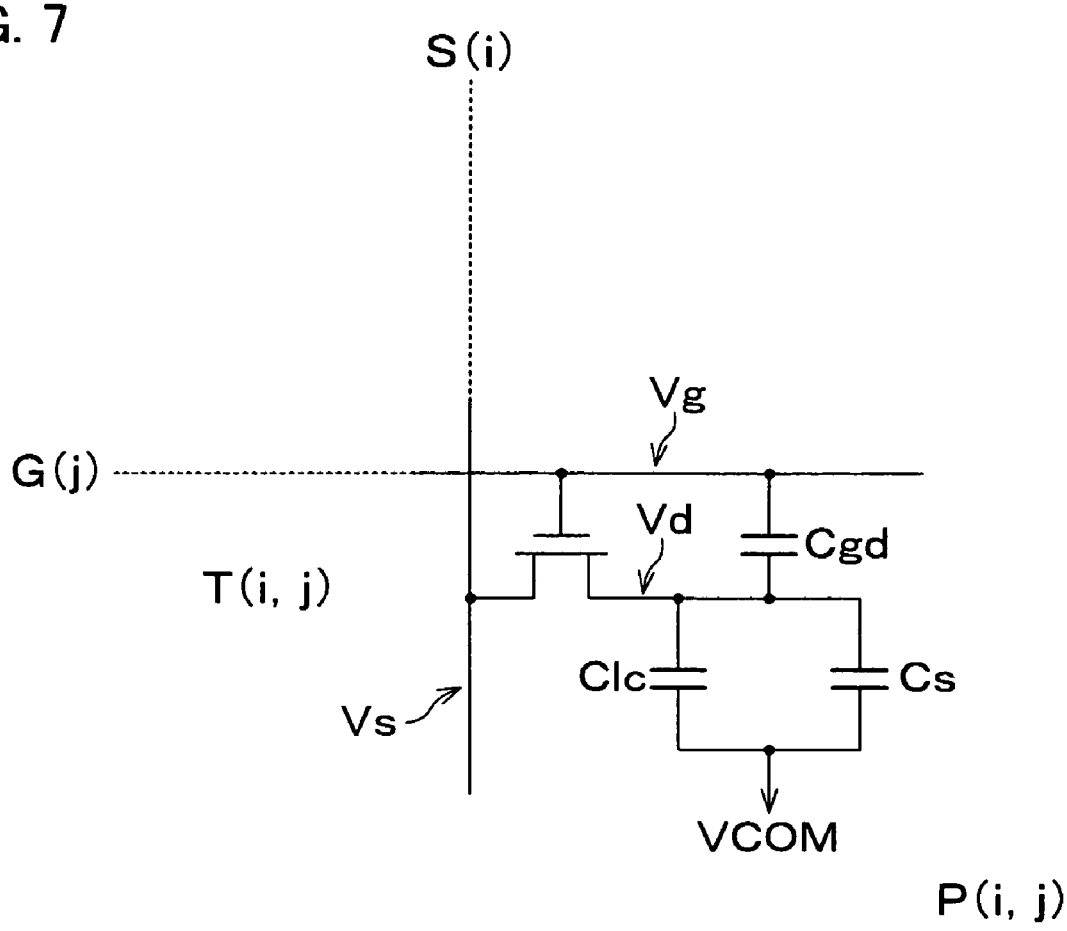
FIG. 7 is an equivalent circuit diagram of a display pixel of a structure in which a pixel capacitor and an auxiliary capacitor are connected in parallel to a counter electrode of a counter electrode driving circuit.
Figure 8:
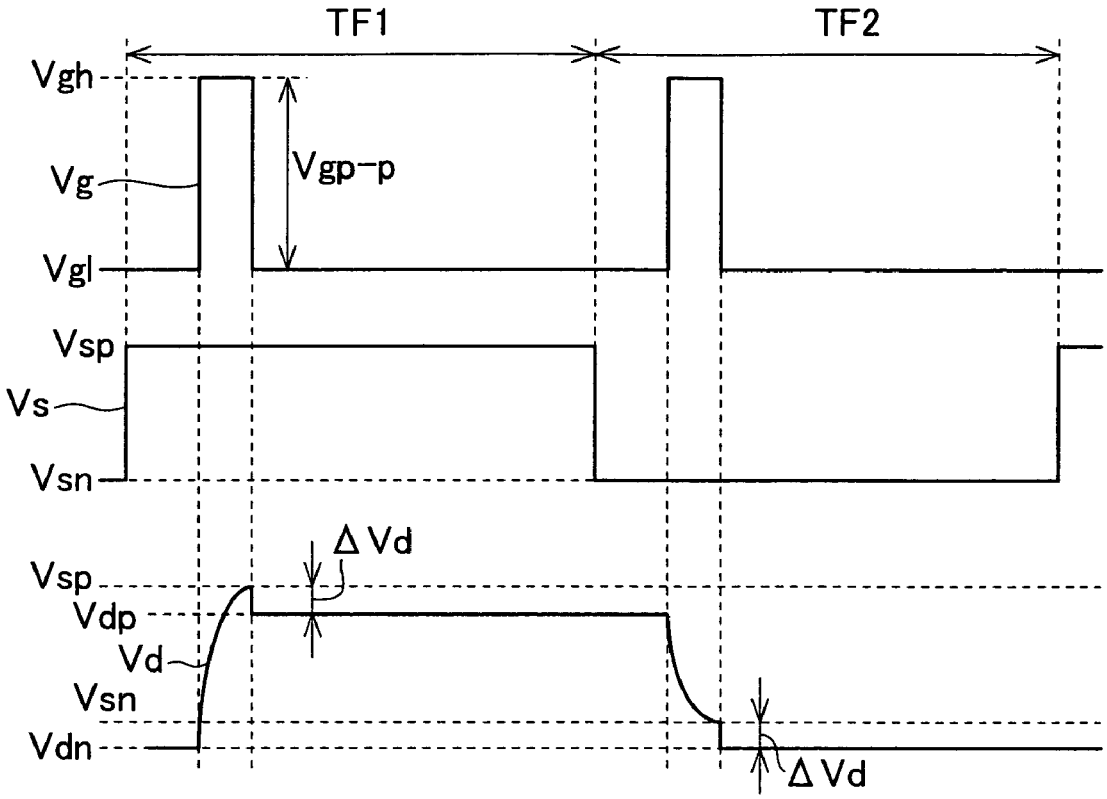
FIG. 8 is a driven waveform chart of a conventional liquid crystal display device.

The output signal (scanning signal production signal) VD1*a* created in the signal production circuit is supplied to the input terminal VD1 of the scanning signal line driving circuit 300 shown in FIG. 6. As shown in FIG. 1, the Stc signal is a timing signal for controlling a gate falling period, and has a period identical to 1 scanning period (TH).

In this structure, when the Stc signal is at a high level, the switch SW1 is OFF and the switches SW2 and SW3 are ON. Therefore, the output signal VD1*a* is outputted as a voltage of a level Vgh to the input terminal VD1 of the scanning signal line driving circuit 300 shown in FIG. 6.

In contrast, when the Stc signal is at a high level, the switch SW1 turns on while the switches 2 and 3 turn off, and the charge conserved in the Ccnt is discharged via the Rcnt, and therefore the voltage level is gradually decreased. The decreased voltage is supplied to the noninverting terminal of the amplifier AMP. In the meantime, the decrease voltage Vgh2, that is a decrease voltage amount from the gate-ON-voltage Vgh, is supplied to the inverting terminal of the amplifier AMP, so that the voltage of the output signal VD1*a* is decreased from the voltage of the gate-ON-voltage Vgh to the voltage of Vgh2, and then further drops with a slope due to a signal generated from the discharge of energy conserved in Ccnt via Rcnt, thereby resulting in a sawtooth signal.

More specifically, the output signal VD1*a* (scanning signal production signal) of FIG. 1 has a high-level section p2, a rising section p1 rising up to a beginning of the high-level section p2, a first falling section p3 falling substantially vertically from a terminating end of the high-level section p2, and a second falling section p4 falling and varying with a slope from a terminating end of the first falling section p3. In other words, the output signal VD1*a* has a high-level section p2 for forming a level for turning on the TFT (switching element) 102, a rising section p1 rising up to a beginning end of the high-level section p2, a falling section p3 falling substantially vertically from a terminating end of the high-level section p2 in a direction for turning off the TFT 102, and a slope falling section p4 falling and varying with a slope from a terminating end of the falling section p3.

Further, the signal production circuit shown in FIG. 2 includes a first input section for inputting a signal voltage Vdd (first voltage) corresponding to the high-level section; a second input section for inputting a signal voltage Vdd2 (second voltage) corresponding to a potential difference between the first voltage and a voltage at the beginning end of the second falling section; a charging section of the signal voltage Vdd; a discharging section for carrying out discharging from the charging section with a predetermined time constant; a voltage subtracting section for subtracting the signal voltage Vdd2 from an output voltage of the charging section; and a switching section for carrying out switching between the charging operation of the charging section with respect to the signal voltage Vdd, and the operation of the subtracting section and the discharging section.

By supplying the output signal VD1*a* (see FIG. 1), that has been produced in the signal production circuit of FIG. 2, to the input terminal VD1 of the scanning signal line driving circuit 300, it is possible to easily produce a waveform with a enough gate-ON-voltage value and a scanning signal falling with a slope, as with the scanning signal VG(j) shown in FIG. 1. The duration of the slope in the waveform can be changed according to the low-period of the Stc signal, and the degree of the slope Vslope may be changed by using variable resistor Rcnt and the capacitor Ccnt that allow adjustment of the time constant. Further, the potential for creating the slope of the signal waveform on the scanning signal line may be optimized for each display panel to be driven, by modifying the gate-ON-voltage (signal voltage Vdd) and the decrease voltage Vgh2 (signal voltage Vdd2, and a voltage value found by a ratio of R1 to R2).

As shown in FIG. 1, in the scanning signal VG(j), the slope of the falling waveform does not necessarily have to extend down to the Vgl level. More specifically, the gate falling slope in the TFT ON area is the matter concerned to prevent variation of the level shift ΔVd in the display surface. In other words, there is no influence of the gate falling speed in the TFT OFF area. Therefore, creation of such a short falling waveform offers a sufficient effect.

As described, the scanning signal (output signal of the scanning signal line driving circuit) of the present embodiment has such a falling waveform, when outputted to the scanning signal line, that first falls substantially vertically (p13) from an ON-level (p12), where the TFT (switching element) 102 turns on, toward an OFF-level, where the TFT (switching element) 102 turns off, and then starts falling with a slope (p14), and again falls substantially vertically (p15) before reaching the OFF-level.

As described, in at least one embodiment, the scanning signal has a waveform that first falls substantially vertically (p13) from an ON-level (p12) of the TFT 102 in a direction of an OFF-level of the TFT 102 and then starts falling with a slope (p14). In this structure, more driving margin of the TFT 102 can be ensured than the structure in which the falling waveform immediately starts falling with a slope from the ON-level of the TFT 102.

More specifically, the switching of the TFT 102 can be performed with a greater driving power if the voltage of the TFT 102 is higher, thereby obtaining a sufficient source-drain current of the TFT 102. On this account, the driving power of the TFT 102 may be fully used, and a sufficient writing period can be ensured even when the writing period for each scanning signal is reduced, thereby displaying an image with high-picture quality.

Further, the display device according to one embodiment includes: a pixel made up of a scanning signal line; a thin film transistor whose gate electrode is connected to the scanning signal line; a video signal line connected to the source electrode of the thin film transistor; a pixel electrode connected to the drain electrode of the thin film transistor, an additional capacitor element formed between the pixel electrode and the signal scanning line; and a liquid crystal capacitor element formed between the drain electrode and a counter electrode, wherein an output signal of the scanning signal line driving circuit has a waveform that first falls substantially vertically from a scanning level (gate-ON-voltage Vgh), and then starts falling with a gentle slope with an arbitrary degree of inclination, toward a non-scanning level.

In this case, it is preferable that the output signal of the scanning signal line driving circuit falls from the scanning level to the non-scanning level with an arbitrary degree of inclination that is determined in consideration of the signal propagation delay characteristic of the scanning signal line. Specifically, in view of the foregoing explanation, the display device is arranged so that, at least for the same scanning signal line, the falling waveform (Vslope section: slope section) of a scanning signal immediately after outputted from the scanning signal line driving circuit is substantially identical to the falling waveform (slope section) of the input section to the pixel having a longest distance to the scanning signal line driving circuit.

In the display device of at least one embodiment, it is preferable that the output signal of the scanning signal line driving circuit falls with a gentle slope from the scanning level to the non-scanning level with an arbitrary degree of inclination that is determined in consideration of the V-I characteristic of the thin film transistor. Since the V-I characteristic is identical in all TFTs aligned on the display panel, the display device has an arrangement such that, at least for the same scanning signal line, the falling waveform (Vslope section: slope section) of a scanning signal immediately after outputted from the scanning signal line driving circuit is substantially identical to the falling waveform (slope section) of the input section to the pixel having a longest distance to the scanning signal line driving circuit.

Further, in the foregoing structure, it is preferable that the output signal of the scanning signal line driving circuit falls with a gentle slope from the scanning level to the non-scanning level with an arbitrary degree of inclination that is determined in consideration of both the signal propagation delay characteristic of the scanning signal line and the V-I characteristic of the thin film transistor. Accordingly, the display device has an arrangement such that, at least for the same scanning signal line, the falling waveform (Vslope section: slope section) of a scanning signal immediately after outputted from the scanning signal line driving circuit is substantially identical to the falling waveform (slope section) of the input section to the pixel having a longest distance to the scanning signal line driving circuit.

Note that, the all explanation from the prior art examples to the embodiment of the invention are made with reference to a liquid crystal display device. However, the present invention may be adopted for all kinds of matrix display devices that has been having the same problems. The embodiments of the present invention are particularly affective for a type using a driving method in which charging is performed by a switching element such as TFT etc. The embodiments of the present invention however may be effective for a display device including, but not limited to an organic EL element or the like, depending on its driving method.

The display device and the display method of the embodiments of the present invention may be adopted for various display devices and display methods in which the video signal line and the scanning signal line are orthogonal to each other, wherein a scanning signal is supplied to the scanning signal line to turn on/off the switching element so that a data signal supplied to the video signal line is written to the pixel electrode.

Thus, in simple terms, the display method for a display device merely can include supplying a signal for displaying information on the display device, wherein a falling waveform of the supplied signal changes slope a plurality of times. The display device may be a matrix display device and the signal may be a voltage signal. More specifically, the display device may be a matrix display device and the signal may be a data signal that is supplied to one of a plurality of pixel electrodes of the matrix display device via a switching element.

Further the supplied signal may have a falling waveform that falls with a first substantially vertical slope, and then falls with a different slope. More specifically, the supplied signal may have a falling waveform that falls with a first substantially vertical slope from an ON-level of the switching element toward an OFF-level of the switching element, and then falls with a different slope. The falling waveform of the supplied signal may again fall substantially vertically after falling at the different slope, or more specifically may again fall substantially vertically after falling at the different slope before reaching the OFF-level of the switching element.

In addition, in another simple form, the method for driving a display device may include storing a display signal with a falling waveform which changes slope a plurality of times and driving the display device using the stored display signal. The display device may be a matrix display device and the display signal may be a voltage signal; or more specifically the display device the display signal may be a data signal that is supplied to one of a plurality of pixel electrodes of the matrix display device via a switching element.

Such a method can include a display signal having a falling waveform that falls with a first substantially vertical slope, and then falls with a different slope; and more specifically a falling waveform that falls with a first substantially vertical slope from an ON-level of the switching element toward an OFF-level of the switching element, and then falls with a different slope.

Further, the falling waveform of the display signal may again falls substantially vertically after falling at the different slope; or more specifically, the falling waveform of the display signal may again fall substantially vertically after falling at the different slope before reaching the OFF-level of the switching element.

In addition, in another simple form, the method for driving a display device may include forming a display signal with a falling waveform which changes slope a plurality of times and driving the display device using the formed display signal. The display device may be a matrix display device and the display signal may be a data signal that is supplied to one of a plurality of pixel electrodes of the matrix display device via a switching element.

The display signal may have a falling waveform that falls with a first substantially vertical slope, and then falls with a different slope; or more specifically the display signal may have a falling waveform that falls with a first substantially vertical slope from an ON-level of the switching element toward an OFF-level of the switching element, and then falls with a different slope. The falling waveform of the display signal may again fall substantially vertically after falling at the different slope; or more specifically the falling waveform of the display signal may again fall substantially vertically after falling at the different slope before reaching the OFF-level of the switching element.

It should be noted that a device for implementing any of the aforementioned methods may also be constructed. The device may include a display panel and a display driver, wherein the driver can be adapted to perform any of the aforementioned methods addressed above. In addition, merely the driver may be constructed to perform any of the aforementioned methods addressed above. Further, a program may be implemented to perform any of the aforementioned methods, when executed on a computer device (a device with a microprocessor or some type of processor). Also, computer readable medium may store any of the programs.

In addition a display signal can be created for supply to a display device to display information on the display device. The display signal may include a rising waveform and a falling waveform, wherein the falling waveform of the display signal changes slope a plurality of times. Such a display signal may be a data signal that is supplied to one of a plurality of pixel electrodes of the matrix display device via a switching element. Further, the display signal may include a falling waveform that falls with a first substantially vertical slope, and then falls with a different slope; or more specifically may include a falling waveform that falls with a first substantially vertical slope from an ON-level of the switching element toward an OFF-level of the switching element, and then falls with a different slope. In addition a falling waveform of the display signal may again fall substantially vertically after falling at the different slope; or more specifically may again falls substantially vertically after falling at the different slope before reaching the OFF-level of the switching element.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

Any of the aforementioned methods may be embodied in the form of a program. The program may be stored on a computer readable media and is adapted to perform any one of the aforementioned methods when run on any type of computer device (device with some type of processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or removable medium arranged so that it can be separated from the computer device main body. Examples of the built-in medium include, but are not limited to, rewriteable involatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable involatile memory, such as memory cards; and media with a built-in ROM, such as ROM cassettes.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A display device for carrying out display, comprising:

means for supplying a data signal, via a video signal line, to one of a plurality of pixel electrodes via a switching element; and means for supplying a scanning signal to a switching element via a scanning signal line, for controlling an ON/OFF state of the switching element, the scanning signal line being orthogonal to the video signal line and connected to the switching element, wherein the supplied signal includes a falling waveform that first falls substantially vertically from an ON-level of the switching element in a direction of an OFF-level of the switching element, and then starts falling with a different slope, and again falls substantially vertically before reaching the OFF-level of the switching element.

2. The display device as set forth in claim 1, wherein:

the ON-level of the switching element is an ON-voltage of the switching element, the direction of an OFF-level of the switching element is a direction of an OFF-voltage of the switching element, and the OFF-level of the switching element is an OFF-voltage of the switching element.

3. The display device as set forth in claim 1, wherein:

the scanning signal is supplied to a gate of the switching element, the ON-level of the switching element is a gate-ON-voltage of the switching element, the direction of an OFF-level of the switching element is a direction of a gate-OFF-voltage of the switching element, and the OFF-level of the switching element is a gate-OFF-voltage of the switching element.

4. The display device as set forth in claim 1, wherein:

the switching element is a thin film transistor, the scanning signal is supplied to a gate of the thin film transistor, the ON-level of the switching element is a gate-ON-voltage of the thin film transistor, the direction of an OFF-level of the switching element is a direction of a gate-OFF-voltage of the thin film transistor, and the OFF-level of the switching element is a gate-OFF-voltage of the thin film transistor.

5. The display device as set forth in claim 1, wherein:

the scanning signal supplied to the switching element to control ON/OFF state of the switching element is a scanning signal having a high-level and a low-level and is supplied to a gate of the switching element, the ON-level of the switching element is the high-level, the direction of an OFF-level of the switching element is a direction of the low-level, and the OFF-level of the switching element is the low-level.

6. The display device as set forth in claim 1, wherein:

the switching element is a thin film transistor, the scanning signal supplied to the switching element to control ON/OFF state of the switching element is a scanning signal having a high-level and a low-level and is supplied to a gate of the thin film transistor, the ON-level of the switching element is the high-level, the direction of an OFF-level of the switching element is a direction of the low-level, and the OFF-level of the switching element is the low-level.

7. The display device as set forth in claim 1, wherein the means for supplying a scanning signal includes a scanning signal line driving circuit for outputting the scanning signal.

8. The display device as set forth in claim 1, wherein:

the scanning signal is produced based on a scanning signal production signal that has a high-level section, a rising section rising up to a beginning of the high-level section, a first falling section falling substantially vertically from a terminating end of the high-level section, and a second falling section falling and varying with a slope from a terminating end of the first falling section.

9. The display device as set forth in claim 8, further comprising:

a signal production circuit for producing the scanning signal production signal, the signal production circuit including:

a first input section for inputting a first voltage corresponding to the high-level section;

a second input section for inputting a second voltage corresponding to a potential difference between the first voltage and a voltage at a beginning end of the second falling section;

a charging section of the first voltage;

a discharging section for carrying out discharging of the charging section with a predetermined time constant;

a voltage subtracting section for subtracting the second voltage from an output voltage of the charging section; and a switching section for carrying out switching between charging operation of the charging section with respect to the first voltage, and operation of the subtracting section and the discharging section.

10. A driving circuit of a display device for carrying out display, comprising:

means for supplying a data signal, via a video signal line, to one of a plurality of pixel electrodes via a switching element; and means for supplying a scanning signal to a switching element via a scanning signal line, for controlling ON/OFF state of the switching element, the scanning signal line being orthogonal to the video signal line and connected to the switching element, wherein the supplied scanning signal includes a falling waveform that first falls substantially vertically from an ON-level of the switching element in a direction of an OFF-level of the switching element, and then starts falling with a different slope, and again falls substantially vertically before reaching the OFF-level of the switching element.

11. The driving circuit of a display device as set forth in claim 10, wherein:

the scanning signal is produced based on a scanning signal production signal that has a high-level section for forming the ON-level of the switching element, a rising section rising up to a beginning end of the high-level section, a falling section falling substantially vertically from a terminating end of the high-level section in the direction of an OFF-level of the switching element, and a slope falling section falling and varying with a slope from a terminating end of the falling section.

12. A display method for carrying out display, comprising:

supplying a data signal, via a video signal line, to one of a plurality of pixel electrodes via a switching element; and supplying a scanning signal to a switching element via a scanning signal line, for controlling ON/OFF state of the switching element, the scanning signal line being orthogonal to the video signal line and connected to the switching element, wherein the supplied scanning signal includes a falling waveform that first falls substantially vertically from an ON-level of the switching element in a direction of an OFF-level of the switching element, and then starts falling with a different slope, and again falls substantially vertically before reaching the OFF-level of the switching element.

13. The display method as set forth in claim 12, wherein:

the ON-level of the switching element is an ON-voltage of the switching element, the direction of an OFF-level of the switching element is a direction of an OFF-voltage of the switching element, and the OFF-level of the switching element is an OFF-voltage of the switching element.

14. The display method as set forth in claim 12, wherein:

the scanning signal is supplied to a gate of the switching element, the ON-level of the switching element is a gate-ON-voltage of the switching element, the direction of an OFF-level of the switching element is a direction of a gate-OFF-voltage of the switching element, and the OFF-level of the switching element is a gate-OFF-voltage of the switching element.

15. The display method as set forth in claim 12, wherein:

the switching element is a thin film transistor, the scanning signal is supplied to a gate of the thin film transistor, the ON-level of the switching element is a gate-ON-voltage of the thin film transistor, the direction of an OFF-level of the switching element is a direction of a gate-OFF-voltage of the thin film transistor, and the OFF-level of the switching element is a gate-OFF-voltage of the thin film transistor.

16. The display method as set forth in claim 12, wherein:

the scanning signal supplied to the switching element to control ON/OFF state of the switching element is a scanning signal having a high-level and a low-level and is supplied to a gate of the switching element, the ON-level of the switching element is the high-level, the direction of an OFF-level of the switching element is a direction of the low-level, and the OFF-level of the switching element is the low-level.

17. The display method as set forth in claim 12, wherein:

the switching element is a thin film transistor, the scanning signal supplied to the switching element to control ON/OFF state of the switching element is a scanning signal having a high-level and a low-level and is supplied to a gate of the thin film transistor, the ON-level of the switching element is the high-level, the direction of an OFF-level of the switching element is a direction of the low-level, and the OFF-level of the switching element is the low-level.

18. The display method as set forth in claim 12, wherein:

the scanning signal is produced based on a scanning signal production signal that has a high-level section, a rising section rising up to a beginning of the high-level section, a first falling section falling substantially vertically from a terminating end of the high-level section, and a second falling section falling and varying with a slope from a terminating end of the first falling section.

19. The display method as set forth in claim 18, wherein:

the scanning signal production signal is produced by keeping and charging for a predetermined period a first voltage corresponding to the high-level section, discharging the first voltage by a predetermined constant, and subtracting a second voltage, that corresponds to a potential difference between the first voltage and a voltage at a beginning end of the second falling section, from a discharge voltage.

* * * * *